US006410833B1

(12) United States Patent
Brando

(10) Patent No.: US 6,410,833 B1
(45) Date of Patent: Jun. 25, 2002

(54) DRUMHEAD TENSIONING DEVICE AND METHOD

(75) Inventor: Marlon Brando, Beverly Hills, CA (US)

(73) Assignee: Penny Poke Farms, Inc., Beverly Hills, CA (US)

( * ) Notice: Subject to any disclaimer, the term of this patent is extended or adjusted under 35 U.S.C. 154(b) by 0 days.

(21) Appl. No.: 09/878,516

(22) Filed: Jun. 8, 2001

(51) Int. Cl.[7] ..... G10D 13/02

(52) U.S. Cl. ..... 84/411 R; 84/421; 84/419; 84/420

(58) Field of Search ..... 84/419, 420, 421, 84/411 R, 413

(56) References Cited

U.S. PATENT DOCUMENTS

| | | | | |
|---|---|---|---|---|
| 3,701,834 A | | 10/1972 | Rubio | 84/419 |
| 3,747,463 A | | 7/1973 | Hinger | 84/419 |
| 4,112,807 A | | 9/1978 | Quibell | 84/411 R |
| 4,122,748 A | | 10/1978 | May | 84/411 A |
| 4,122,749 A | | 10/1978 | Hoellerich | 84/419 |
| 4,244,265 A | | 1/1981 | Tuttrup | 84/411 R |
| 4,278,003 A | * | 7/1981 | Hanson | 84/411 A |
| 4,635,524 A | | 1/1987 | Allen et al. | 84/419 |
| 4,694,726 A | | 9/1987 | Silvestri | 84/413 |
| 4,709,613 A | | 12/1987 | Powers et al. | 84/413 |
| 4,831,912 A | | 5/1989 | Allen et al. | 84/419 |
| 4,909,125 A | | 3/1990 | Fece | 84/411 A |
| 5,392,681 A | | 2/1995 | Hall | 84/413 |
| 6,043,421 A | | 3/2000 | Adams | 84/419 |

FOREIGN PATENT DOCUMENTS

| | | |
|---|---|---|
| GB | 592979 | 10/1947 |

* cited by examiner

*Primary Examiner*—Robert E. Nappi
*Assistant Examiner*—Kim Lockett
(74) *Attorney, Agent, or Firm*—Seed Intellectual Property Law Group PLLC; Kevin S. Costanza

(57) ABSTRACT

In a tunable drum, a connector member in the drum is attached by cables to a tuning ring, and is threadedly coupled by a tuning linkage to a retaining member fixed to the drum. Rotation of the tuning linkage with respect to the drum moves the connector member longitudinally and, as a result, adjusts the tension of the drumhead. In one embodiment, a handle fixed to the tuning linkage is positioned to engage a complementary coupling in a drum stand when the drum is retained by the drum stand. In another embodiment, the complementary coupling is movable between an operative position in which the drum can be tuned by rotating it with respect to the stand, and inoperative position in which the drum can be placed in the stand without the handle engaging the complementary coupling.

20 Claims, 8 Drawing Sheets

DRUMHEAD TENSIONING DEVICE AND METHOD

TECHNICAL FIELD

The present invention is directed toward percussion drums and, in particular, to apparatus, systems and methods for adjusting the tension of a drumhead.

BACKGROUND OF THE INVENTION

Percussion drums have been used for hundreds, if not thousands, of years to produce sounds either alone or in combination with other musical instruments. A typical drum has a hollow body or shell over which a drumhead is stretched. A typical drumhead is circular and terminates at its outer boundary at a rigid or substantially rigid rim. When the drumhead is placed over the mouth of the shell, the rim is positioned slightly outside of the shell. A tensioning ring is positioned over the rim and is attached to the shell to retain the drumhead in tension across the mouth.

The tensioning ring is commonly attached to the shell by a number of threaded rods that extend between the tensioning ring and brackets on the outer surface of the shell. Threaded nuts are tightened on the threaded rods to move the tensioning ring toward the brackets, thus tightening the drumhead. A typical drum has six or more of such threaded rods. Accordingly, adjusting the tension in the drumhead typically requires the tightening of six or more separate nuts.

A number of tuning mechanisms have been developed in the past to make tuning the drumhead easier. Most of these mechanisms are incorporated into kettle drums, such as that illustrated in U.S. Pat. No. 4,831,912 to Allen et al. Other mechanisms, such as those illustrated in U.S. Pat. No. 4,244,265 to Tuttrup and U.S. Pat. No. 4,909,125 to Fece, have been developed for other types of drums.

None of the devices known to the inventor provide a simple and affordable drumhead tuner that is at the same time accurate and reliable. The mechanisms illustrated in Allen et al. and Fece, for example, are elaborate and likely expensive to manufacture. Accordingly, although they may be appropriate for expensive drums of the type illustrated therein, they may be inappropriate for simpler and/or less expensive types of drums.

Further, the mechanisms illustrated in Fece and Tuttrup are both subject to inadvertent adjustments that may accidentally modify the tone of the drum. The Fece device may be accidentally rotated, which would result in the drumhead tension changing. Similarly, the cables extending along the outside of the shell of the Tuttrup device could be displaced by the drummer or a drum stand, or the jackscrew inadvertently impinged, to accidentally change the tone of the drum.

It is therefore apparent that a need exists for a simple and inexpensive drum tuning device that is also accurate and reliable and not subject to inadvertent adjustments.

SUMMARY OF THE INVENTION

The present invention is directed toward a tunable drum for use with or without a drum stand having a first coupling fixed thereto that rotates as a unit with the drum stand. Embodiments of the invention allow an individual to quickly and reliably tune the drum either manually or by rotating the drum in the drum stand.

In one particular embodiment, the drum incorporates a shell, a drumhead, a tuning ring and an adjustment assembly. The shell has opposing first and second ends with a first mouth at the first end and a second mouth at the second end.

The drumhead covers the first mouth, and is retained against the shell by the tuning ring. The tuning ring is held against the drumhead by a number of cords, cables or other elongated linkages. The cables extend from the tuning ring to the adjustment assembly through holes in the shell.

The adjustment assembly is made up of a connector member, a retaining member, a tuning linkage and a second coupling. The connector member is positioned inside the shell, and the cables are coupled to the connector member. The retaining member is positioned within the shell on the side of the connector member toward the second end of the shell, and is coupled to the shell to remain longitudinally fixed within the shell. The tuning linkage is threadedly coupled between the retaining member and the connector member such that rotation of the tuning linkage moves the connector member longitudinally within the shell and, as a result, adjusts the tension of the drumhead.

In another embodiment, a handle is fixed to the tuning linkage, and is positioned to engage a complementary coupling in the drum stand when the drum is retained by the drum stand.

In still another embodiment, the complementary coupling on the drum stand is movable between operative and inoperative positions. In the operative position, the coupling in the drum stand engages the handle, and the drum can be tuned by rotating it with respect to the drum stand. In the inoperative position, the drum can be placed in the drum stand without the handle engaging the complementary coupling.

DETAILED DESCRIPTION OF THE ILLUSTRATED EMBODIMENTS

The present detailed description is generally directed toward systems, apparatus and methods for reliably and accurately tuning a drumhead, and for preventing accidental adjustments to the drumhead's tension. Several embodiments of the invention allow an individual to tune the drumhead manually or by rotating the drum within the drum stand of the invention. The inventive drum stand, however, can be configured to prevent accidental changes to the tension of the drumhead.

Many specific details of certain embodiments of the invention are set forth in the following description and in FIGS. 1–10 to provide a thorough understanding of such embodiments. One skilled in the art, however, will understand that the present invention may have additional embodiments, or may be practiced without several of the details described in the following description.

Figure 1:
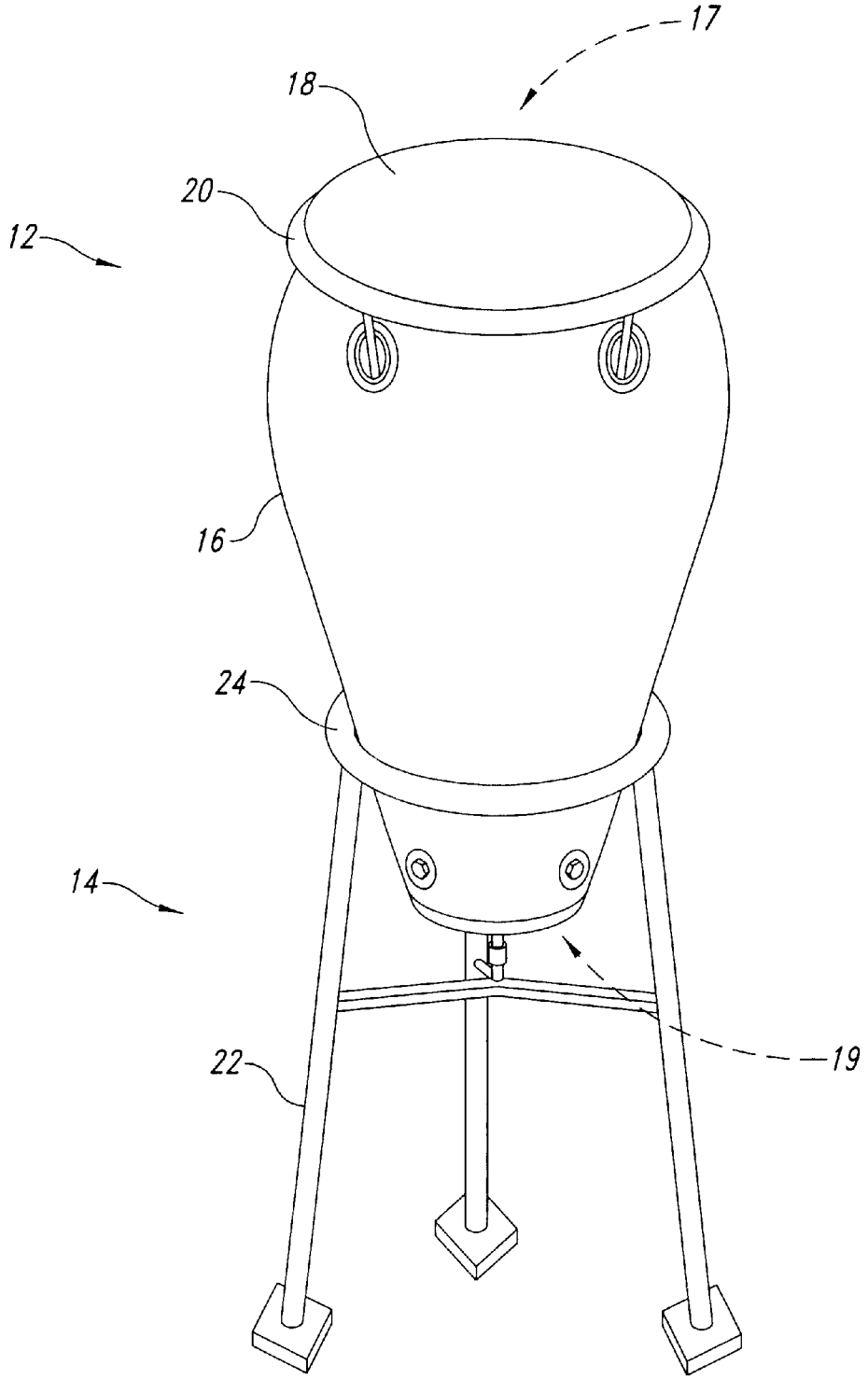
FIG. 1 is an isometric view of a drum and a drum stand according to one particular embodiment of the present invention.
Figure 2:
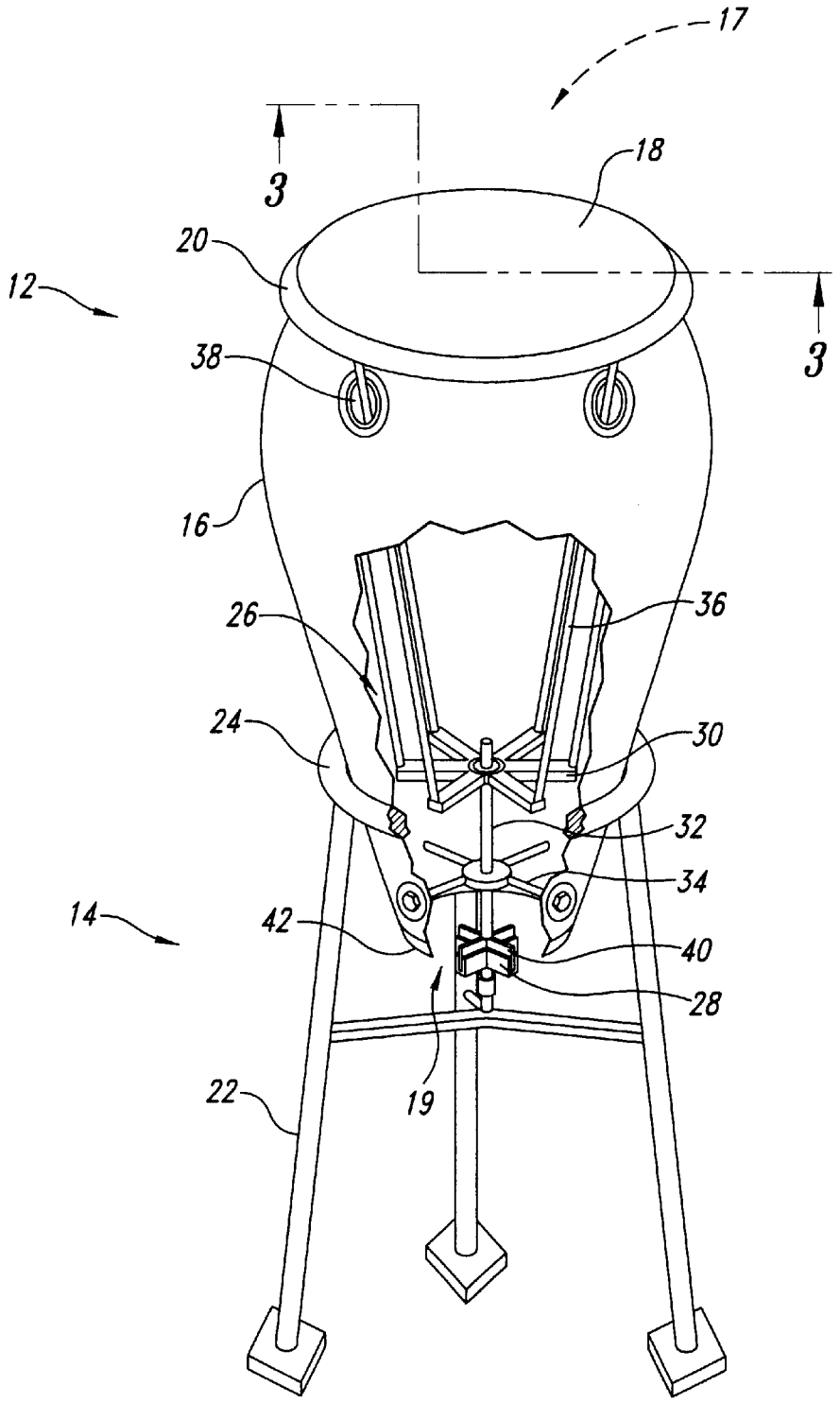
FIG. 2 is an isometric cutaway view of the drum and the drum stand of FIG. 1, illustrating a tuning assembly according to this particular embodiment of the present invention.

FIG. 1 generally illustrates a drum 12 and drum stand 14 according to one embodiment of the present invention. The drum 12 generally has a shell 16, a drumhead 18 and a tuning ring 20. The shell 16 in the illustrated embodiment is in the form of a conga drum, having an upper mouth 17 at one end and a lower mouth 19 at the opposite end. As illustrated in FIG. 2, in this particular embodiment, the drumhead 18 covers the upper mouth 17, while the lower mouth 19 remains open to the surrounding environment. The inventor appreciates, and one of ordinary skill in the art will understand, that the present invention can apply to a wide variety of drum types. For simplicity purposes, however, the following disclosure is directed toward the illustrated conga drum version of the present invention.

The illustrated drum stand 14 has three legs 22 supporting an upper ring 24 that encircles and retains the drum shell 16 when the drum 12 is in the drum stand. The upper ring 24 can be padded to protect the surface of the shell 16, and can be coated with a surface treatment to prevent the shell from rotating with respect to the drum stand when the shell is fully seated therein.

FIG. 2 best illustrates a tuning assembly 26 within the drum 12 engaged with an actuator 28 on the drum stand 14. The tuning assembly 26 incorporates a spider member 30, a threaded rod 32, and a retaining member 34. The spider member 30 is a type of connector member, i.e., it connects the tuning ring 20 to the tuning assembly 26 by a number of cables 36. Each cable 36 is coupled to the tuning ring 20 at a location outside the shell 16, extends through a hole 38 in the shell, and is coupled to the spider member 30 at a location inside the shell 16. As discussed in more detail below, the threaded rod 32 passes through the retaining member 34 before terminating at a handle or key 40 at its lower end, and can be rotated by the user to serve as a tuning linkage for the drum. In the illustrated embodiment, the key 40 is positioned above a bottom rim 42 of the shell 16 so the drum 12 can be set on a flat surface without the key impinging upon the flat surface. The retaining member 34 is fixed to the shell 16, as discussed in more detail below.

Figure 3:
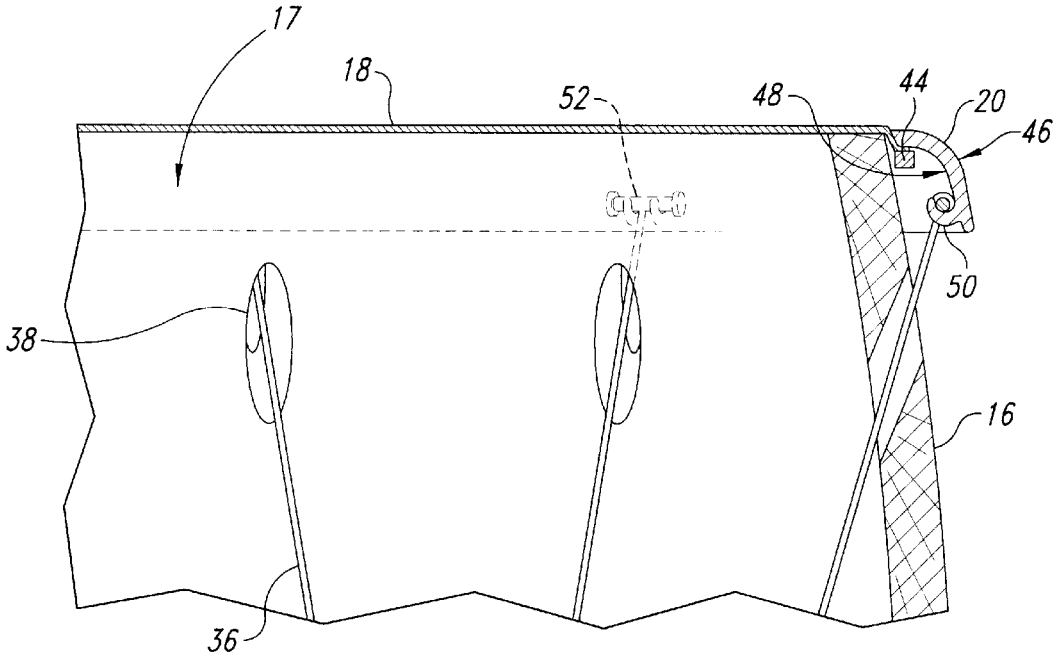
FIG. 3 is a sectional elevation view of an upper portion of the drum of FIG. 2, seen along Section 3—3.

FIG. 3 illustrates the relationship between the drumhead 18, the tuning ring 20 and the cables 36 in this particular embodiment. The drumhead 18 is generally circular, and terminates at its outer edge at an enlarged rim or bead 44. The bead 44 is positioned slightly outside the shell 16 when the drumhead 18 is properly fitted on the shell. The tuning ring 20 is complementary in shape to the shell 16 to fit over the shell and contact the enlarged bead 44 along its entire perimeter. Thus, urging the tuning ring 20 downward results in an increased tension in the drumhead 18. An upper surface 46 of the tuning ring 20 is curved downward, and is smooth to allow an individual to comfortably play the drum. A lower surface 48 of the tuning ring 20 has a number of hairs of prongs 50 spaced about the perimeter of the tuning ring to align with the holes 38. Each prong 50 projects inward from the lower surface 48 and upward when configured for use. The pair of prongs 50 thus creates a fastener to which an elongated rod 52 at the upper end of the cable 36 can be retained. The cable 36 can be wrapped around the elongated rod 52, or can be attached by any other means generally understood in the art. As discussed above, the cables 36 extend downward from the tuning ring 20, through the openings 38 in the shell 16 to the tuning assembly (not shown).

Figure 4:
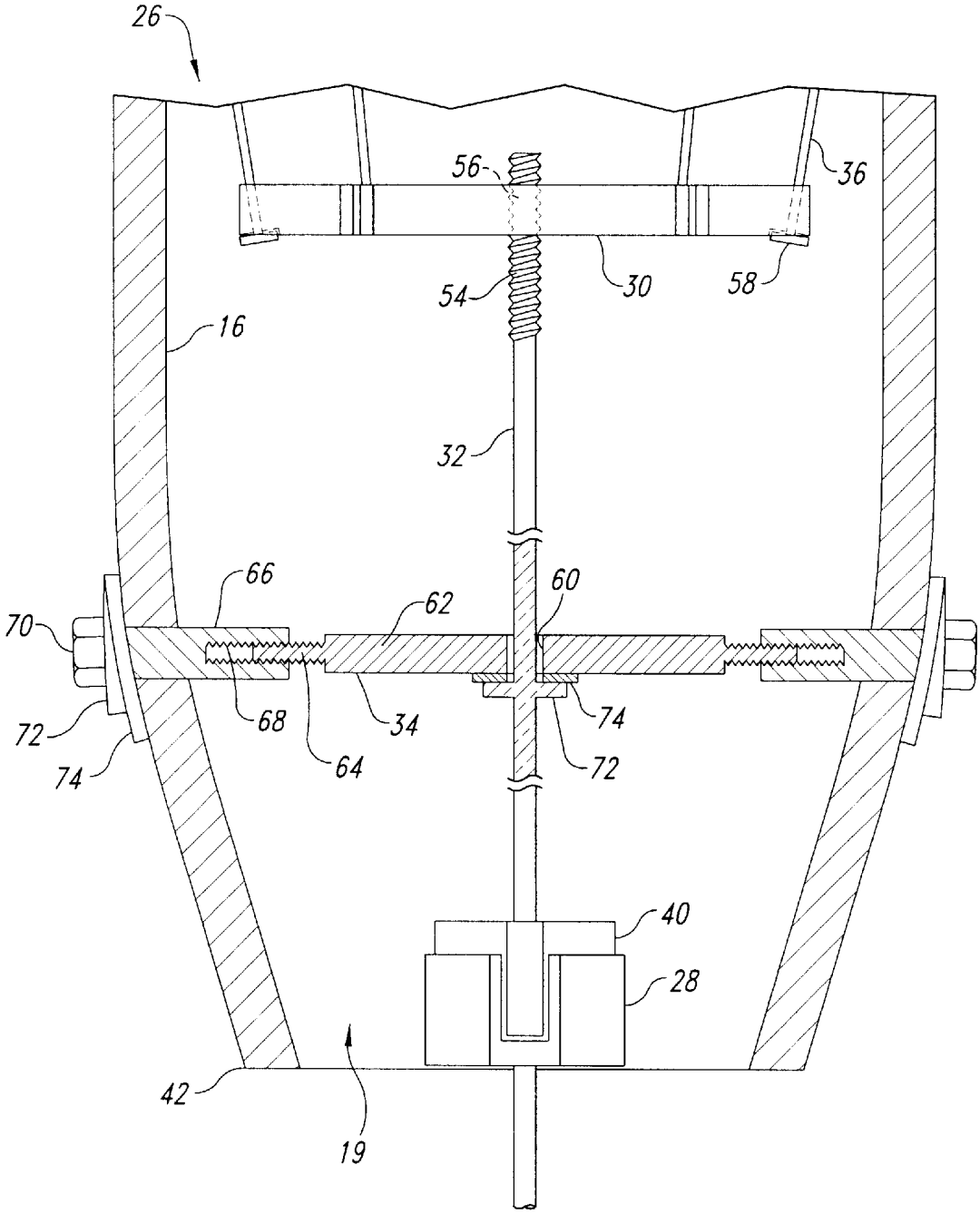
FIG. 4 is an elevation view of a lower portion of the drum of FIG. 2 illustrating the tuning assembly engaged with a portion of the drum stand of FIG. 2, shown with portions of the invention cut along a diametric section.

FIG. 4 illustrates the tuning assembly 26 according to the present embodiment. The spider member 30 is suspended between the cables 36 and the threaded rod 32. A threaded distal end 54 of the threaded rod 32 engages a complementary threaded opening 56 in the spider member 30. Rotation of the spider member 30 with respect to the threaded rod 32 thus results in relative axial movement between the spider member and the threaded rod. As discussed in more detail below, this relative axial movement ultimately results in changing the tension of the drumhead 18. The lower ends of the cables 36 each terminate in an enlarged head 58, that is retained by the spider member 30.

The retaining member 34 of the illustrated embodiment is in the form of a cross with an aperture 60 at the intersection of four legs 62. Each leg 62 terminates at its distal end in a threaded portion 64. An elongated nut 66 having internal threads 68 extends through the shell 16 and threadedly engages the threaded portion 64 of each leg 62. The outer end of the elongated nut 66 terminates in a bolt head 70. In the illustrated embodiment, a washer 72 and a decorative plate 74 are positioned between the bolt head 70 and the shell 16. The retaining member 34 is thus fixedly attached to the shell 16. The inventor appreciates as would one of ordinary skill in the art that many different variations can be made to this particular structure without deviating from the spirit of the invention.

The threaded rod 32 extends from the spider 30 through the retaining member 34, where an enlarged, annular shoulder 72 prevents the threaded rod from moving axially toward the upper end of the drum. A bearing 74 is positioned between the annular shoulder 72 and the retaining member 34 to allow the threaded rod 32 to rotate with respect to the retaining member with reduced friction. Because the threaded rod 32 is prevented by the retaining member 34 from moving axially upward, when the threaded rod is rotated with respect to the spider member 30 the spider member moves downward toward the retaining member.

Figure 10:
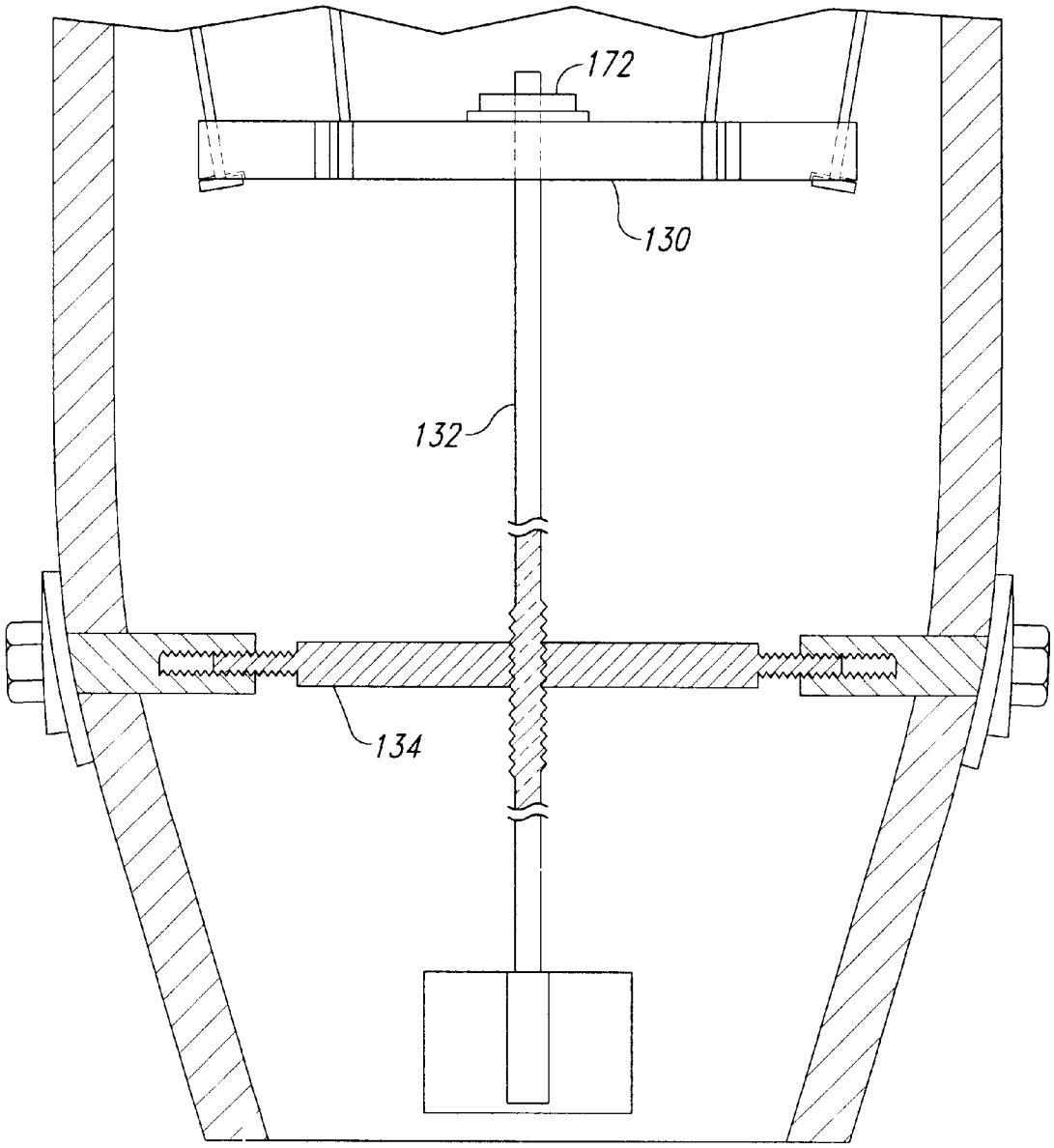
FIG. 10 is an elevation view of a lower portion of a drum and a tuning assembly according to another embodiment of the present invention, shown with portions of the drum cut along a diametric section.

The inventor and one of ordinary skill in the art would appreciate that many various structures can be used to move the spider member 30 axially with respect to the threaded rod 32. For example, as illustrated in FIG. 10, a threaded rod 132 can be threadedly engaged with a retaining member 134 and a shoulder 172 at the extreme distal end of the threaded rod can be seated above a spider member 130 such that rotation of the threaded rod with respect to the retaining member causes the threaded rod, and with it the spider member, to move axially. The inventor appreciates that still further variations can be made without deviating from the spirit of the invention.

Figure 5:
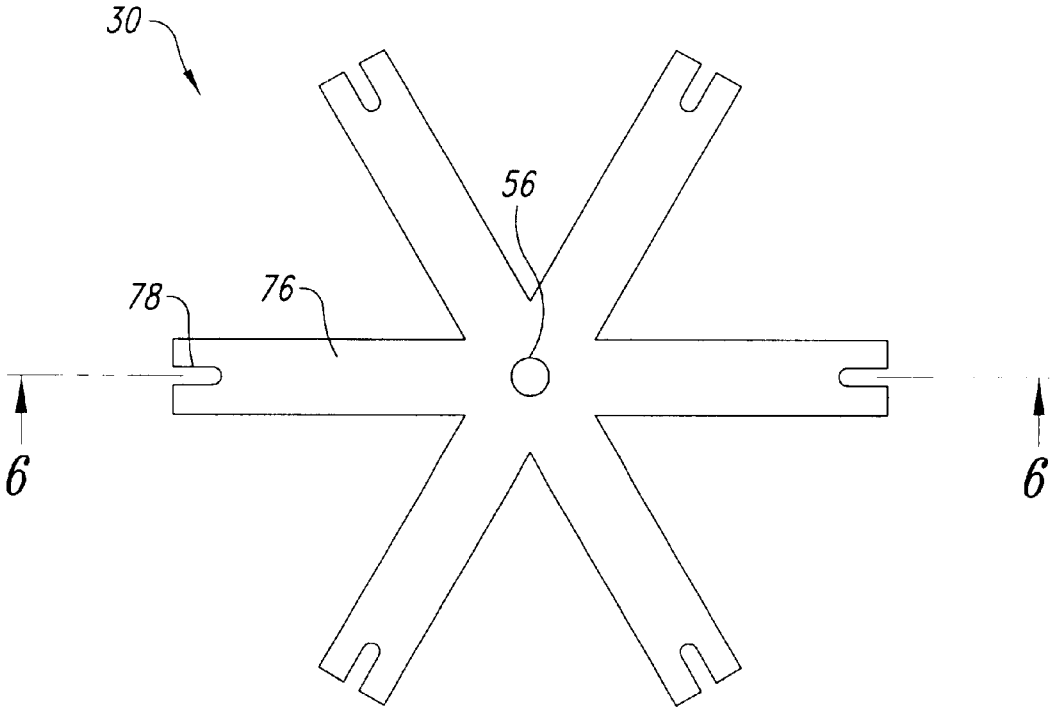
FIG. 5 is a plan view of a spider member of the tuning assembly of FIG. 4.
Figure 6:
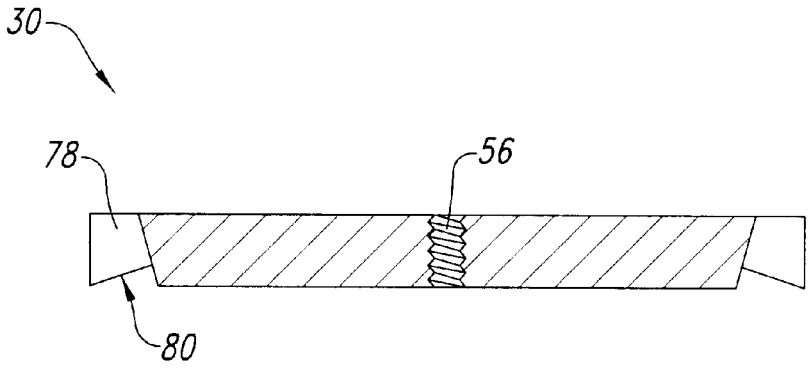
FIG. 6 is a sectional elevation view of the spider member of FIG. 5, seen along Section 6—6.

FIGS. 5 and 6 further illustrate the spider member 30 of the present embodiment. In the illustrated embodiment, six arms 76 project outward, corresponding to the six cables (not shown). For situations where more or fewer cables are used, the spider member 30 would have a different number of arms 76 to correspond with the number of cables in such a situation. The arms 76 are spaced radially at roughly equal angles with respect to the other arms to evenly distribute the forces that the cables 36 exert on the spider member 30. Each arm 76 terminates at its distal end in a groove 78. The groove 78 is sufficiently wide to receive the length of a cable 36 (not shown), but sufficiently narrow to prevent the head 58 (not shown) at the lower end of the cable from passing through the spider member 30. As illustrated in FIG. 6, a bottom surface 80 is tapered to compensate for the angle of the cable 36 as it extends upward from the spider member 30 and outward toward the tuning rim 20 (not shown). The inventor appreciates that other variations or shapes can be used for the spider member 30 without deviating from the spirit of the present invention. For example, a disk-shaped plate with detents distributed about its perimeter could be used. Likewise, the spider member 30 need not be flat, but instead could be curved downward to provide additional strength and/or to obviate the need for the tapered bottom surface 80.

Figure 7:
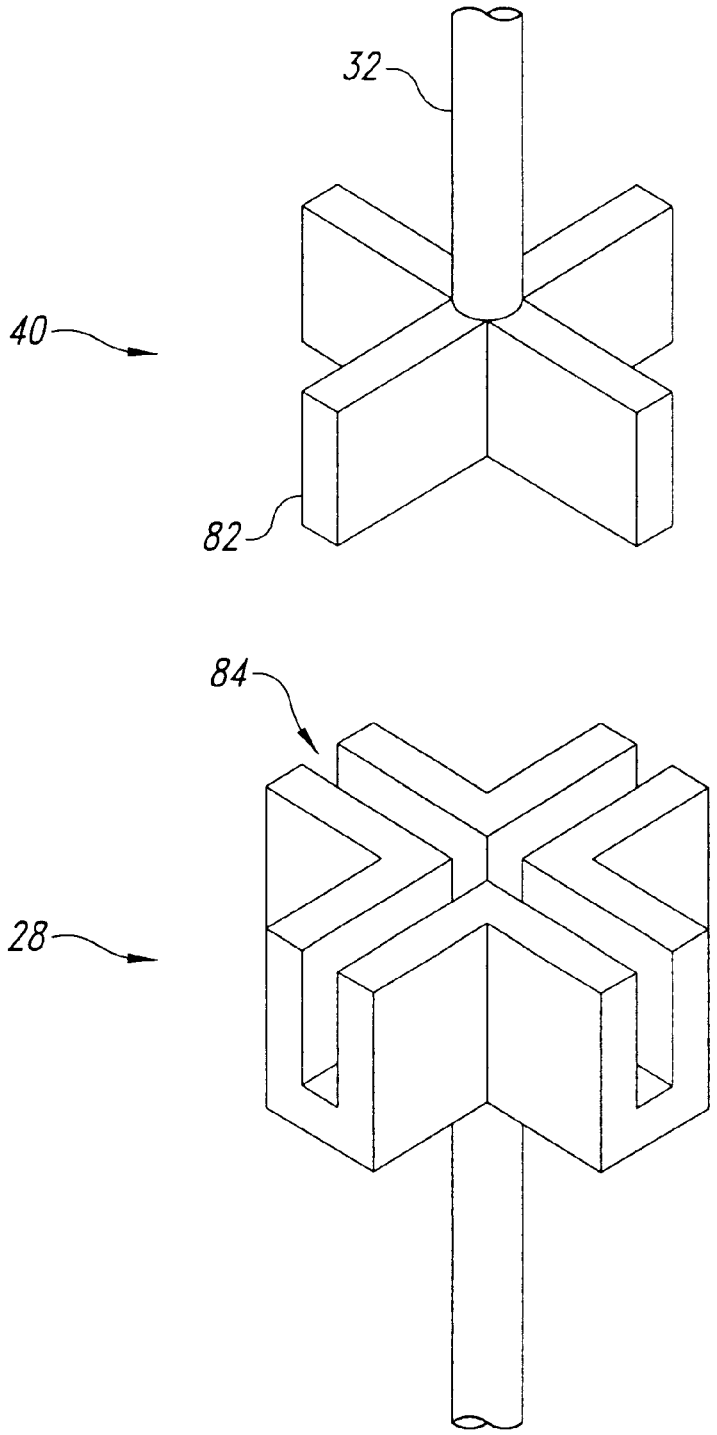
FIG. 7 is an isometric view of a lower portion of the tuning assembly of FIG. 4 and an actuator from the drum stand of FIG. 4.

FIG. 7 better illustrates the key 40, and the actuator 28 of this particular embodiment. The key 40 is fixedly attached to the extreme bottom end of the threaded rod 32. In the illustrated embodiment, the key is in the shape of a Greek cross, although it is appreciated that any number of regular or irregular shapes (other than a circle) can be substituted therefore. The key 40 incorporates four engagement members 82 to facilitate rotating the threaded rod 32. The engagement members 82 are sized to allow an individual to manually rotate the threaded rod 32 in addition to allowing the individual to rotate the threaded rod using the drum stand. Accordingly, configurations for the key 40 that facilitate both manual and assisted rotation would be optimal.

The actuator 28 has a number of channels 84 therein configured to complement the engagement members 82 on the key 40. The channels 84 are open to the top to allow the key 40 to be lowered into the actuator 28 from above when the drum is placed in the stand. The actuator 28 is fixed to the drum stand 14 to prevent relative rotation between the actuator and the stand.

Figure 9:
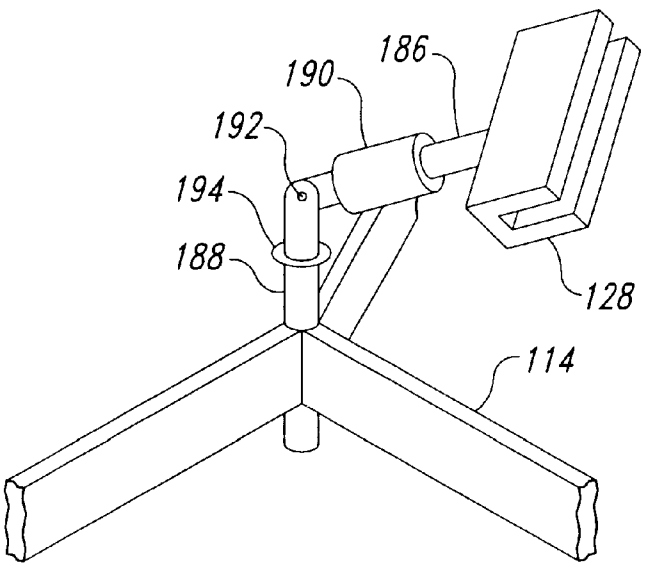
FIG. 9 is an isometric view of the actuator of FIG. 8, shown in an inoperative configuration.
Figure 8:
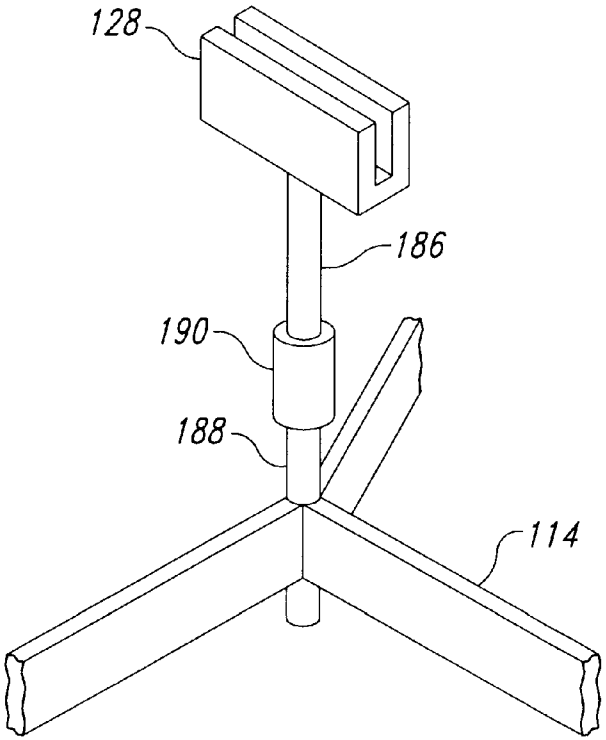
FIG. 8 is an isometric view of an actuator of a drum stand according to another particular embodiment of the present invention, shown in an operative configuration.

FIGS. 8 and 9 illustrate the operative and inoperative configurations, respectively, of another embodiment the actuator of 128. The actuator 128 is connected to the stand 114 by an upper linkage 186 and a lower linkage 188. A locking member 190 is positioned between the upper and lower linkages 186/188 to retain the linkages in axial alignment. In this configuration, i.e., the operating configuration, the actuator 128 is upright and positioned to receive the key (not shown) for tuning the drum.

In FIG. 9, the actuator 128 is in the inoperative configuration. In this configuration, the locking member 190 has moved from the locked position to the unlocked position, allowing the upper linkage 186 to move with respect to the lower linkage 188. In the illustrated embodiment, the upper linkage 186 is pivotally connected at a hinge 192 to the lower linkage 188. The locking member 190 is a sliding collar that, when moved upward, exposes the hinge 192 to allow the actuator 128 to move into the inoperative configuration. When the actuator 128 is moved into the operative configuration, the locking member 190 is able to slide downward over the hinge 192 until it contacts a raised section 194. When the locking member 192 has slid downward until it contacts the raised section 194, the locking member prevents the upper linkage 186 from pivoting with respect to the lower linkage 188, retaining the actuator 128 in the operative configuration. The inventor appreciates that other configurations can be used to perform the above function, and thus various alterations and modifications to this illustrated structure would not deviate from the spirit of the present invention.

Embodiments of the present invention have numerous advantages over devices of the prior art. For example, because the key is manipulable both by hand and with the drum stand, the invention allows an individual to conveniently tune the invention both with and without the drum stand, and allows an individual to easily remove the drum from the drum stand to prevent accidental changes to the tension of the drumhead. To further prevent accidental changes, the cables extending from the tuning ring to the tuning assembly of the present invention extend almost entirely inside the drum shell. Thus, the drummer's hands, knees or the drum stand will not accidentally contact the cables, putting them in further tension and accidentally altering the tone of the drum.

Still further, because the actuator of the present invention is movable between operative and inoperative configurations, the drum can be left in the drum stand between uses and during use without the risk of accidentally changing the tension in the drumhead. Instead, the user merely moves the actuator into the inoperative position and uses the drum without worry that the tension of the drumhead will accidentally be changed.

Still further, because the tuning assembly is retained entirely within the boundaries of the shell, the drum can be set on the ground or otherwise carried and utilized without structural members getting in the way.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A system for facilitating the tuning of a drum, the system comprising:

a shell having a first mouth at a first end and a second mouth at a second end, the second end being opposite the first end along a radial axis of the shell;

a drumhead covering the first mouth, the drumhead having a rim about its outer edge, the rim being positioned outside the shell;

a tuning ring positioned over the drumhead, the tuning ring having an opening therein shaped to receive the first end of the shell and to prevent the rim from passing through the tuning ring;

a plurality of cables having first and second ends, the first end of each of the cables being coupled to the tuning ring, the cables extending from the tuning ring into the shell through a plurality of holes in the shell;

a connector member positioned inside the shell, the second end of each of the cables being coupled to the connector member;

a retaining member positioned within the shell, the retaining member being coupled to the shell to remain longitudinally fixed with respect to the radial axis of the shell;

a tuning linkage threadedly coupled between the retaining member and the connector member such that rotation of the tuning linkage moves the connector member longitudinally with respect to the radial axis and, as a result, adjusts the tension of the drumhead; and a handle projecting from the tuning linkage, the handle being fixed to the tuning linkage to rotate therewith about the radial axis, and being manually manipulable to tune the drumhead.

2. The system of claim 1, further comprising a stand configured to support the drum, the stand having an actuator thereon shaped and positioned to engage the handle when the drum is supported by the stand, the actuator being rotatably fixed to the stand such that rotation of the drum with respect to the stand when the actuator is engaged with the handle results in relative rotation between the tuning linkage and the drum, adjusting the tension of the drumhead.

3. The system of claim 1, further comprising a stand configured to support the drum, the stand having an actuator thereon shaped complement the handle, the actuator being selectively movable between an operative position in which the actuator engages the handle when the drum is retained by the stand, and an inoperative position in which the actuator does not engage the handle when the drum is retained by the stand, the actuator being rotatably fixed to the stand such that rotation of the drum with respect to the stand when the actuator is engaged with the handle results in relative rotation between the tuning linkage and the drum, adjusting the tune of the drumhead.

4. The system of claim 1 wherein the connector member is threadedly engaged with the tuning linkage and the tuning linkage is axially fixed with respect to the retaining member such that rotation of the tuning linkage with respect to the connector member results in the connector member moving axially with respect to the shell.

5. The system of claim 1 wherein the retaining member is threadedly engaged with the tuning linkage and the connector member is axially fixed with respect to the tuning member such that rotation of the tuning linkage with respect to the retaining member results in the tuning member and the connector member both moving axially with respect to the shell.

6. The system of claim 1 wherein the handle is completely contained within the shell.

7. A tunable drum for use with a drum stand, the drum stand having an actuator fixed thereto to rotate as a unit with the drum stand, the drum comprising:

a shell having a first mouth at a first end and a second mouth at a second end, the second end being opposite the first end along a radial axis of the shell, the second end being configured to be releasibly retained by the drum stand;

a drumhead covering the first mouth, the drumhead having a rim about its outer edge, the rim being positioned outside the shell;

a tuning ring positioned over the drumhead, the tuning ring having an opening therein shaped to receive the first end of the shell and to prevent the rim from passing through the tuning ring;

a plurality of elongated links having first and second ends, the first end of each of the links being coupled to the tuning ring, the links extending from the tuning ring into the shell through a plurality of holes in the shell;

a connector member positioned inside the shell, the second end of each of the links being coupled to the connector member;

a retaining member positioned within the shell, the retaining member being coupled to the shell to remain longitudinally fixed with respect to the radial axis of the shell;

a tuning linkage threadedly coupled between the retaining member and the connector member such that rotation of the tuning linkage moves the connector member longitudinally with respect to the radial axis and, as a result, adjusts the tension of the drumhead; and a handle fixed to the tuning linkage to rotate therewith about the radial axis, the handle being positioned to engage the actuator when the drum is retained by the drum stand, and being sized and shaped to rotate with the actuator such that rotation of the shell with respect to the drum stand rotates the tuning linkage with respect to the shell and adjusts the tension of the drumhead.

8. The drum of claim 7 wherein the connector member is threadedly engaged with the tuning linkage and the tuning linkage is axially fixed with respect to the retaining member such that rotation of the tuning linkage with respect to the connector member results in the connector member moving axially with respect to the shell.

9. The drum of claim 7 wherein the retaining member is threadedly engaged with the tuning linkage and the connector member is axially fixed with respect to the tuning member such that rotation of the tuning linkage with respect to the retaining member results in the tuning member and the connector member both moving axially with respect to the shell.

10. The drum of claim 7 wherein the handle is completely contained within the shell.

11. A stand for retaining a drum and tuning a drumhead on the drum, the drum having a handle thereon that is rotatable to adjust the tension of the drumhead, the stand comprising:

an actuator attached to the stand, the actuator being selectively movable between an operative position in which the actuator will engage the handle when the drum is retained by the stand, and an inoperative position in which the actuator will not engage the handle when the drum is retained by the stand, the actuator being rotatably fixed to the stand such that rotation of the drum with respect to the stand when the actuator is engaged with the handle results in relative rotation between the handle and the drum, adjusting the tension of the drumhead.

12. The stand of claim 11 wherein the actuator projects upward when in the operative position such that lowering the drum into the stand when the actuator is in the operative position will result in engagement between the handle and the actuator.

13. The stand of claim 11 wherein the actuator is pivotable between the operative and inoperative positions.

14. The stand of claim 11 wherein the actuator projects upward when in the operative position such that lowering the drum into the stand when the actuator is in the operative position will result in engagement between the handle and the actuator, and wherein the actuator is pivotable between the operative and inoperative positions.

15. The stand of claim 11 wherein the actuator is bilaterally symmetric.

16. The stand of claim 11 wherein the actuator is symmetrical about two axes.

17. The stand of claim 11, further comprising a retention member configured to resist relative rotation between the drum and the stand when the drum is retained in the stand.

18. A tuning assembly for a drum having a drumhead retained thereon by a tuning ring, for use in combination with a drum stand having an actuator rotatably fixed thereto, the tuning assembly comprising:

a connector member sized and shaped to be positioned inside the drum, the connector member being attachable to the tuning ring by a plurality of linkages extending from the tuning ring into the drum such that longitudinal movement of the connector member with respect to the drum will change the tension of the drumhead;

a retaining member attachable to the drum to remain longitudinally fixed with respect to the drum, a tuning linkage threadedly coupled between the connector member and the retaining member such that rotation of the tuning linkage moves the connector member longitudinally with respect to the retaining member and, as a result, will adjust the tension of the drumhead; and a handle fixed to the tuning linkage to rotate therewith, the handle being positioned to engage the actuator when the tuning assembly is positioned within the drum and the drum is retained by the drum stand, and being sized and shaped to complement the actuator and rotate therewith such that rotation of the drum in the drum stand will rotate the tuning linkage and adjust the tension of the drumhead.

19. A tuning assembly for use in combination with a drum having a shell and a drumhead retained onto the shell by a tensioning ring, the tuning assembly comprising:

a connector member sized and shaped to be positioned inside the shell, the connector member being coupleable to the tensioning ring by a plurality of linkages extending from the tensioning ring into the shell, such that axial movement of the connector member with respect to the shell changes the tension of the drumhead;

a retaining member attachable to the shell to remain axially fixed with respect to the shell;

a tuning linkage threadedly coupled between the connector member and the retaining member such that rotation of the tuning linkage results in axial movement of the connector member with respect to the retaining member and, as a result, a change in the tension of the drumhead; and a handle projecting from the tuning linkage, the handle being rotatably fixed with respect to the tuning linkage and being manually manipulable to rotate with the tuning linkage to change the tension of the drumhead.

20. A method for tuning a drum having a shell and a drumhead attached to the shell by a tensioning ring, the method comprising:

fixing a retaining member with respect to the shell;

linking a connector member positioned inside the shell to the tensioning ring;

threadedly coupling a tuning linkage between the retaining member and the connector member such that rotation of the tuning linkage results in axial movement of the connector member; and rotating a handle projecting from the tuning linkage until the drumhead is subject to a desired tension.

* * * * *